US010012007B2

(12) United States Patent
Jin

(10) Patent No.: US 10,012,007 B2
(45) Date of Patent: Jul. 3, 2018

(54) TENT FRAME AND TENT WITH SLIDABLY COUPLED TOP POLES

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/482,565

(22) Filed: Apr. 7, 2017

(65) Prior Publication Data

US 2017/0292286 A1 Oct. 12, 2017

(30) Foreign Application Priority Data

Apr. 7, 2016 (CN) ..... 2016 2 0282742 U

(51) Int. Cl.

| | |
|---|---|
| ***E04H 15/48*** | (2006.01) |
| ***E04H 15/46*** | (2006.01) |
| ***E04H 15/42*** | (2006.01) |
| ***E04H 15/52*** | (2006.01) |

(52) U.S. Cl.

CPC ..... *E04H 15/48* (2013.01); *E04H 15/425* (2013.01); *E04H 15/46* (2013.01); *E04H 15/52* (2013.01)

(58) Field of Classification Search

CPC ..... E04H 15/48; E04H 15/425
USPC ..... 135/120.1, 120.2, 120.3, 156, 121, 139, 135/143, 144, 141, 114, 146
See application file for complete search history.

(56) References Cited

U.S. PATENT DOCUMENTS

| | | | | |
|---|---|---|---|---|
| 14,655 A | | 4/1856 | Hartwell | |
| 58,283 A | | 9/1866 | Palmer | |
| 379,274 A | | 3/1888 | Hamilton | |
| 910,117 A | * | 1/1909 | Crocker | E04H 15/003 135/141 |
| 952,879 A | * | 3/1910 | Crocker | E04H 15/003 135/141 |
| 1,061,547 A | | 5/1913 | Kennedy | |
| 1,129,194 A | | 2/1915 | Henley | |
| 1,347,107 A | | 7/1920 | McCann | |
| 1,601,664 A | | 9/1926 | Ackerman | |
| 1,687,722 A | | 10/1928 | Goldberg | |
| 2,113,118 A | | 4/1938 | Pyati | |
| 2,227,554 A | | 1/1941 | Riordon | |

(Continued)

FOREIGN PATENT DOCUMENTS

| | | |
|---|---|---|
| CA | 2022369 A1 | 2/1991 |
| CN | 1076987 A | 10/1993 |

(Continued)

*Primary Examiner* — Noah Chandler Hawk
(74) *Attorney, Agent, or Firm* — Morgan, Lewis & Bockius LLP

(57) ABSTRACT

Disclosed are tent frames and tents. A tent frame includes first and second top poles, first and second connectors, and a locking mechanism. Each of the first and second top poles has a first end portion and a second end portion. The first connector is fixedly coupled to the first end portion of the first top pole, and slidably coupled to and movable along the second pole. The second connector is fixedly coupled to the first end portion of the second top pole, and slidably coupled to and movable along the first top pole. The locking mechanism selectively restricts the first and second top poles from moving with respect to each other.

23 Claims, 10 Drawing Sheets

(56) References Cited

U.S. PATENT DOCUMENTS 2,306,706 A 12/1942 Lucas
2,448,895 A 9/1948 Lawrence
2,530,765 A 11/1950 Greenup
2,555,220 A 5/1951 Brown
2,716,993 A 9/1955 Codrick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,454,021 A * 7/1969 Morris ..... E04H 15/42 135/118
3,738,378 A 6/1973 Williams
3,766,932 A 10/1973 Sidis
3,810,482 A 5/1974 Beavers
3,929,146 A 12/1975 Maiken
4,003,181 A 1/1977 Robinson
4,037,978 A 7/1977 Connelly
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,285,355 A 8/1981 Lundblade
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,827,958 A 5/1989 Cantwell
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A 3/1991 Niksic
5,230,358 A 7/1993 Forell
5,240,020 A 8/1993 Byers
5,255,698 A 10/1993 Riley
5,263,507 A 11/1993 Chuang
5,293,890 A 3/1994 Park et al.
5,328,286 A 7/1994 Lee
5,333,634 A 8/1994 Taylor
5,361,794 A 11/1994 Brady
5,421,355 A 6/1995 Cantwell
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A 6/1998 Shiina
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,230,728 B1 5/2001 Reese
6,283,136 B1 9/2001 Chen
6,286,530 B1 9/2001 Hussey
6,296,415 B1 10/2001 Johnson et al.
6,463,948 B2 10/2002 Lee
6,516,823 B1 2/2003 Glovert et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,299,813 B2 11/2007 Ochi
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,686,024 B1 3/2010 Lai
7,810,514 B2 10/2010 Lah
7,861,736 B2 1/2011 Choi
7,891,367 B2 2/2011 Ma
8,047,218 B1 11/2011 Shin
8,056,573 B2 11/2011 Panigot
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,590,554 B2 11/2013 Choi
D705,884 S 5/2014 Jin
8,763,621 B2 7/2014 Jin
8,869,814 B2 10/2014 Jin
8,910,648 B2 12/2014 Jin
8,919,364 B1 * 12/2014 Russell ..... E04H 15/46 135/139
9,051,034 B1 6/2015 Li
9,140,030 B2 9/2015 Jin
9,192,215 B2 11/2015 Ma
9,243,423 B2 1/2016 Jin
9,243,424 B2 1/2016 Jin
9,382,723 B2 7/2016 Choi
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffman
2008/0223425 A1 * 9/2008 Shumate ..... E04H 15/62 135/116
2009/0173369 A1 7/2009 Lah
2012/0055525 A1 3/2012 Choi
2012/0318316 A1 12/2012 Choi et al.
2013/0014794 A1 1/2013 Jin
2013/0247948 A1 9/2013 Lovely et al.
2014/0076371 A1 3/2014 Jin
2014/0076372 A1 3/2014 Jin
2014/0109945 A1 4/2014 Jin
2014/0246062 A1 9/2014 Ma
2014/0261601 A1 9/2014 Jin
2014/0290710 A1 10/2014 Choi
2014/0311540 A1 * 10/2014 Choi ..... E04H 15/42 135/143
2015/0068573 A1 3/2015 Jin
2015/0083177 A1 3/2015 Hotes
2015/0167343 A1 6/2015 Fang
2015/0167344 A1 * 6/2015 Li ..... E04H 15/48 135/143
2015/0275541 A1 10/2015 Lamke
2015/0284974 A1 10/2015 Choi
2016/0060897 A1 * 3/2016 Baoqing ..... E04H 15/60 135/146
2016/0242567 A1 8/2016 Lime
2016/0281385 A1 9/2016 Choi
2016/0290003 A1 10/2016 Yang

FOREIGN PATENT DOCUMENTS

CN 1030790 C 1/1996
CN 2401649 Y 10/2000
CN 2506736 Y 8/2002
CN 2635827 Y 8/2004
CN 2697225 Y 5/2005
CN 201013097 Y 1/2008
CN 201103269 Y 8/2008

(56) References Cited

FOREIGN PATENT DOCUMENTS

| | | | |
|---|---|---|---|
| CN | 201129060 | Y | 10/2008 |
| CN | 201202302 | Y | 3/2009 |
| CN | 201695751 | U | 1/2011 |
| CN | 102691439 | A | 9/2012 |
| CN | 201220478761.4 | | 9/2012 |
| CN | 202767622 | U | 3/2013 |
| CN | 203034904 | U | 7/2013 |
| CN | 103590650 | B | 2/2014 |
| CN | 204163467 | U | 2/2015 |
| FR | 1 121 851 | | 8/1956 |
| FR | 68588 | | 5/1958 |
| GB | 2201703 | A | 9/1988 |
| GB | 2259927 | A | 3/1993 |
| KR | 10-2011-0054253 | A | 5/2011 |
| WO | WO 2011/022764 | A1 | 3/2011 |
| WO | WO 2013/116545 | A1 | 8/2013 |
| WO | WO 2014/181953 | A1 | 11/2014 |

* cited by examiner

TENT FRAME AND TENT WITH SLIDABLY COUPLED TOP POLES

CROSS-REFERENCE TO RELATED APPLICATIONS

The present application claims priority to Chinese Utility Model Application CN 201620282742.2 filed Apr. 7, 2016. The disclosure of the application is incorporated herein for all purposes by reference in its entirety.

FIELD OF THE INVENTION

The present invention generally relates to tent frames and tents, and more particularly, relates to tent frames and tents with slidably coupled top poles.

BACKGROUND

Typical existing tents have a single top pole. To provide a larger space for use, the single top pole is usually long. Such a long single top pole is inconvenient for storage, shipping and transportation. As such, it increases the transportation cost and decreases the profits.

To reduce the sizes of the folded tents while maintaining the capability of providing a relatively larger usable space when unfolded, some existing tents utilize a telescopic top pole. An example of such tents is disclosed in Chinese Patent No. 201420213980.9, entitled "A Tent Frame", the disclosure of which is incorporated herein for all purposes by reference in its entirety. The tent frame includes a top pole made of an inner pole and an outer pole telescopically coupled to each other. The inner pole is smaller than the outer pole. However, to support the tent cloth and other members of the tent when the tent is unfolded, the inner pole needs to withstand substantially the same amount of force as the outer pole. As such, the inner pole may need to be made of a material different than that of the outer pole, or have a thicker wall than that of the outer pole. In addition, as the inner pole and the outer pole are telescopically coupled to each other, the tent cloth cannot be folded or unfolded along with the tent frame. As such, the tent is not convenient to use.

Given the current state of the art, there remains a need for tent frames and tents that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides tent frames and tents that are easy to fold and unfold, have a relatively larger usable space when unfolded, and are compact when folded.

In various exemplary embodiments, the present invention provides a tent frame including first and second top poles, first and second connectors, and a locking mechanism. Each of the first and second top poles has a first end portion and a second end portion. The first connector is fixedly coupled to the first end portion of the first top pole, and slidably coupled to and movable along the second pole. The second connector is fixedly coupled to the first end portion of the second top pole, and slidably coupled to and movable along the first top pole. The locking mechanism selectively restricts the first and second top poles from moving with respect to each other.

In some exemplary embodiments, at least the first end portion of the second top pole is hollow and includes a hole formed at a wall of the first end portion of the second top pole. In such embodiments, the locking mechanism includes a U-shaped elastic member, a protrusion and a knob. The U-shaped elastic member is disposed inside of the first end portion of the second top pole. The protrusion is disposed at or integrally formed with the U-shaped elastic member. The U-shaped elastic member pushes the protrusion outwardly such that the protrusion is protruded outside of the second top pole through the hole formed at the first end portion of the second top pole. The knob is disposed at or integrally formed with the first connector. The knob includes a receptacle and a push button. The receptacle is to receive the protrusion, thereby restricting the first and second top poles from moving with respect to each other. The push button is to push the protrusion out of the receptacle of the knob or out of both the receptacle of the knob and the hole formed at the first end portion of the second top pole, thereby allowing the first and second top poles to move with respect to each other. In an exemplary embodiment, the protrusion is disposed or integrally formed at or adjacent to an end of the U-shaped elastic member.

In some exemplary embodiments, the tent frame further includes a first rotatable pole having a first end portion pivotally connected to the first connector. The first rotatable pole is rotatable towards the second connector between a first position and a second position. In an exemplary embodiment, the first position is substantially perpendicular to the second top pole and the second position is substantially parallel to the second top pole. In some exemplary embodiments, the first rotatable pole includes a first fastener at a second end portion thereof to couple with a tent cloth.

In some exemplary embodiments, the tent frame further includes a second rotatable pole having a first end portion pivotally connected to the second connector. The second rotatable pole is rotatable towards the first connector between a third position and a fourth position. In an exemplary embodiment, the third position is substantially perpendicular to the first top pole and the fourth position is substantially parallel to the first top pole. In some exemplary embodiments, the second rotatable pole includes a second fastener at a second end portion thereof to couple with a tent cloth.

In some exemplary embodiments, the tent frame further includes first and second pluralities of supporting poles, and third and fourth connectors. The third connector is pivotally connected to the second end portion of the first top pole. The fourth connector is pivotally connected to the second end portion of the second top pole. Each supporting pole in the first plurality of supporting poles is pivotally connected to the third connector. Each supporting pole in the second plurality of supporting poles is pivotally connected to the fourth connector.

In some exemplary embodiments, the first or second plurality of supporting poles includes two, three or more supporting poles. In an exemplary embodiment, each supporting pole in the first or second plurality of supporting poles is telescopic, or has a length that is adjustable. In some exemplary embodiments, each supporting pole in the first or second plurality of supporting poles includes an upper supporting pole and a lower supporting pole. The upper supporting pole has first and second end portions, with the first end portion pivotally connected to the third or fourth connector. The lower supporting pole has a first end portion pivotally coupled to a second end portion of the upper supporting pole, and a second end portion to be disposed at a ground. In an exemplary embodiment, the lower supporting pole is telescopic, or has a length that is adjustable.

In various exemplary embodiments, the present invention provides a tent including a tent cloth and a tent frame of the present invention disclosed herein to support the tent cloth.

The tent frames and the tents of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Figure 1:
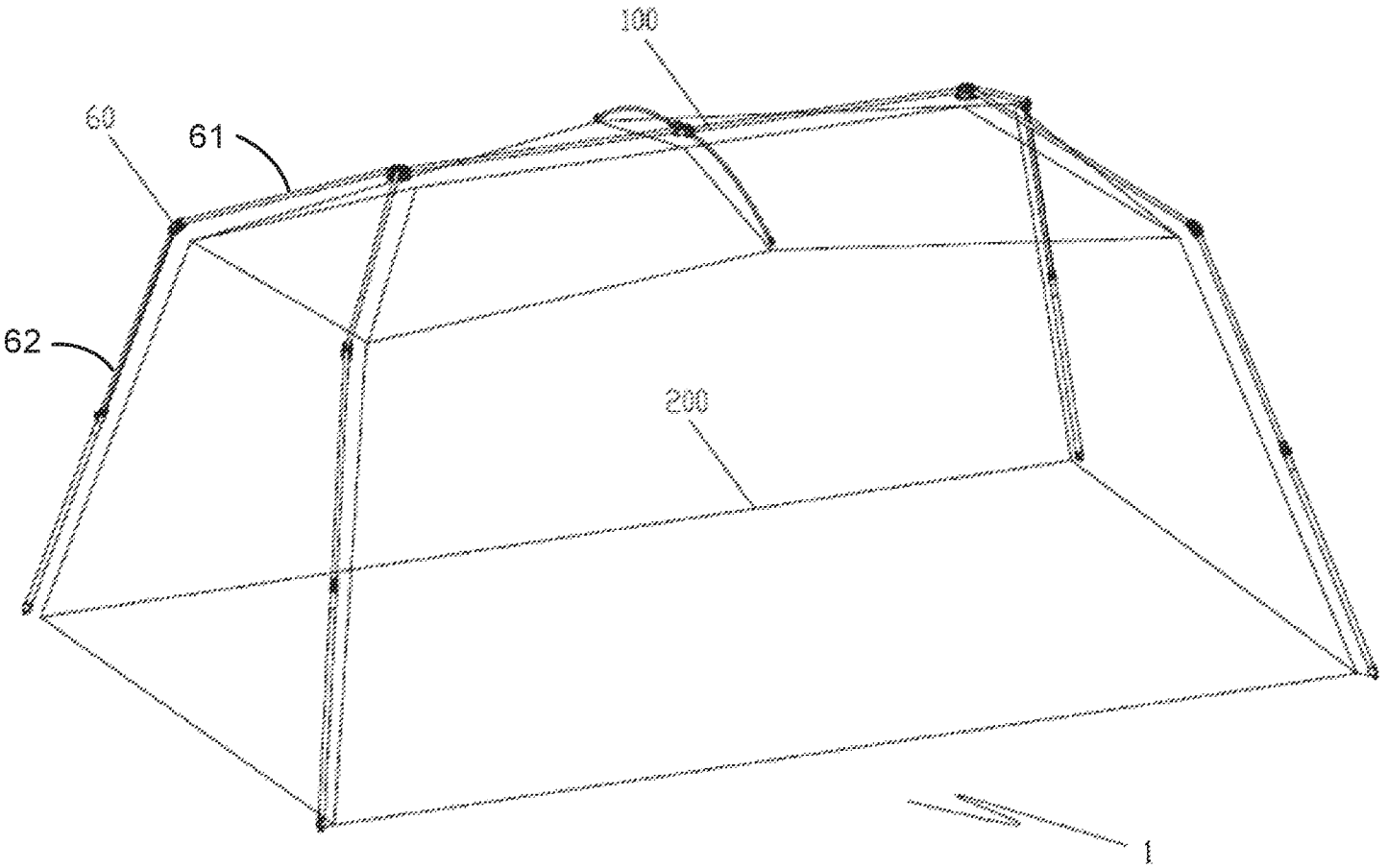
FIG. 1 is a schematic diagram illustrating an exemplary tent in an unfolded state in accordance with some exemplary embodiments of the present invention.
Figure 2:
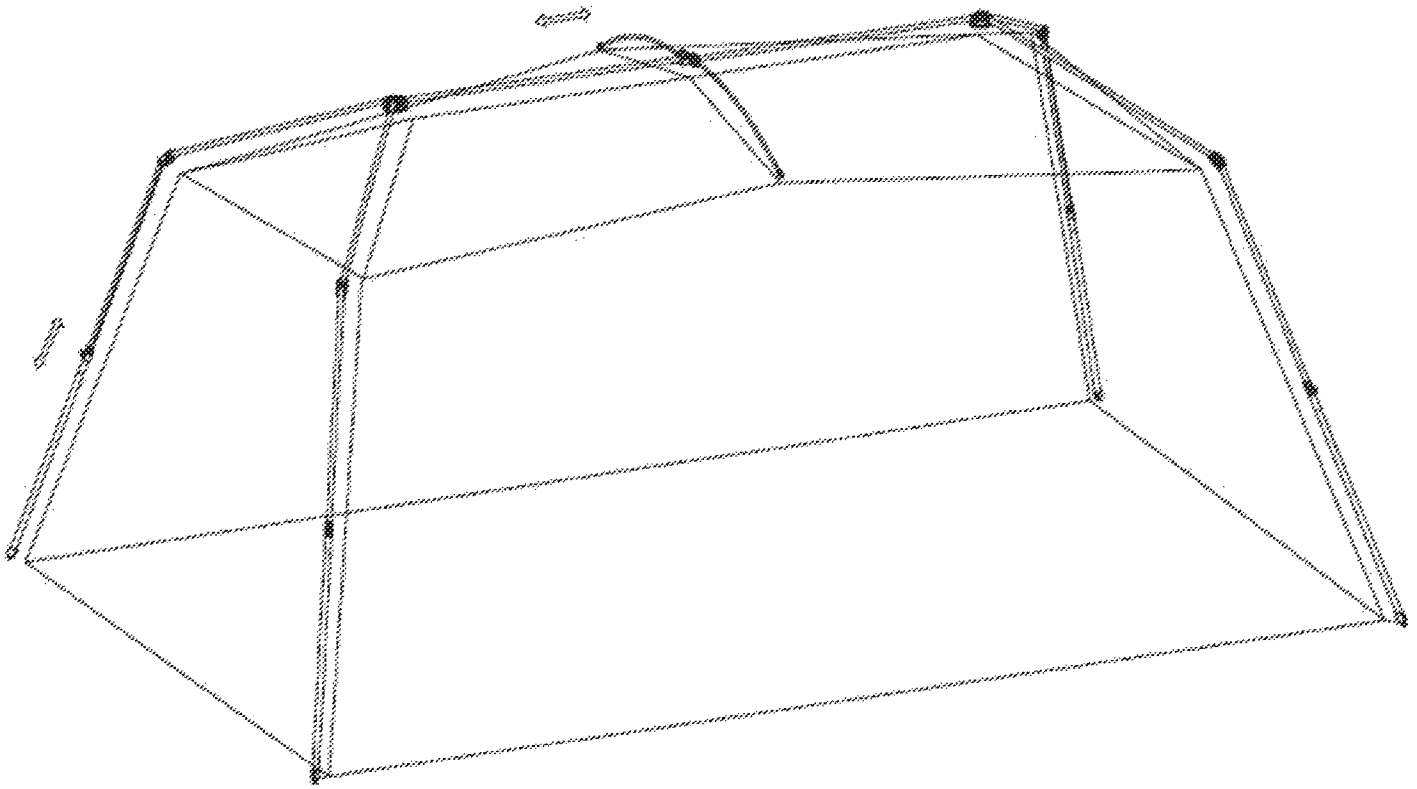
FIG. 2 is a schematic diagram illustrating exemplary folding and unfolding processes of the exemplary tent of FIG. 1 in accordance with some exemplary embodiments of the present invention.
Figure 3:
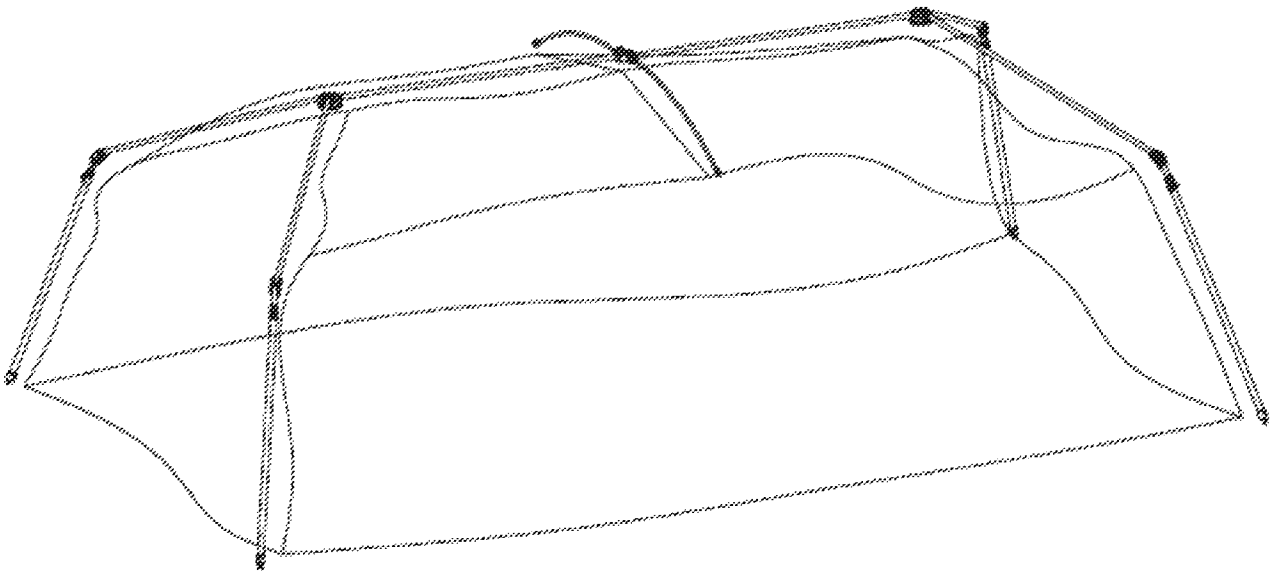
FIG. 3 is a schematic diagram illustrating the exemplary tent of FIG. 1 in a first partially folded state in accordance with some exemplary embodiments of the present invention.
Figure 4:
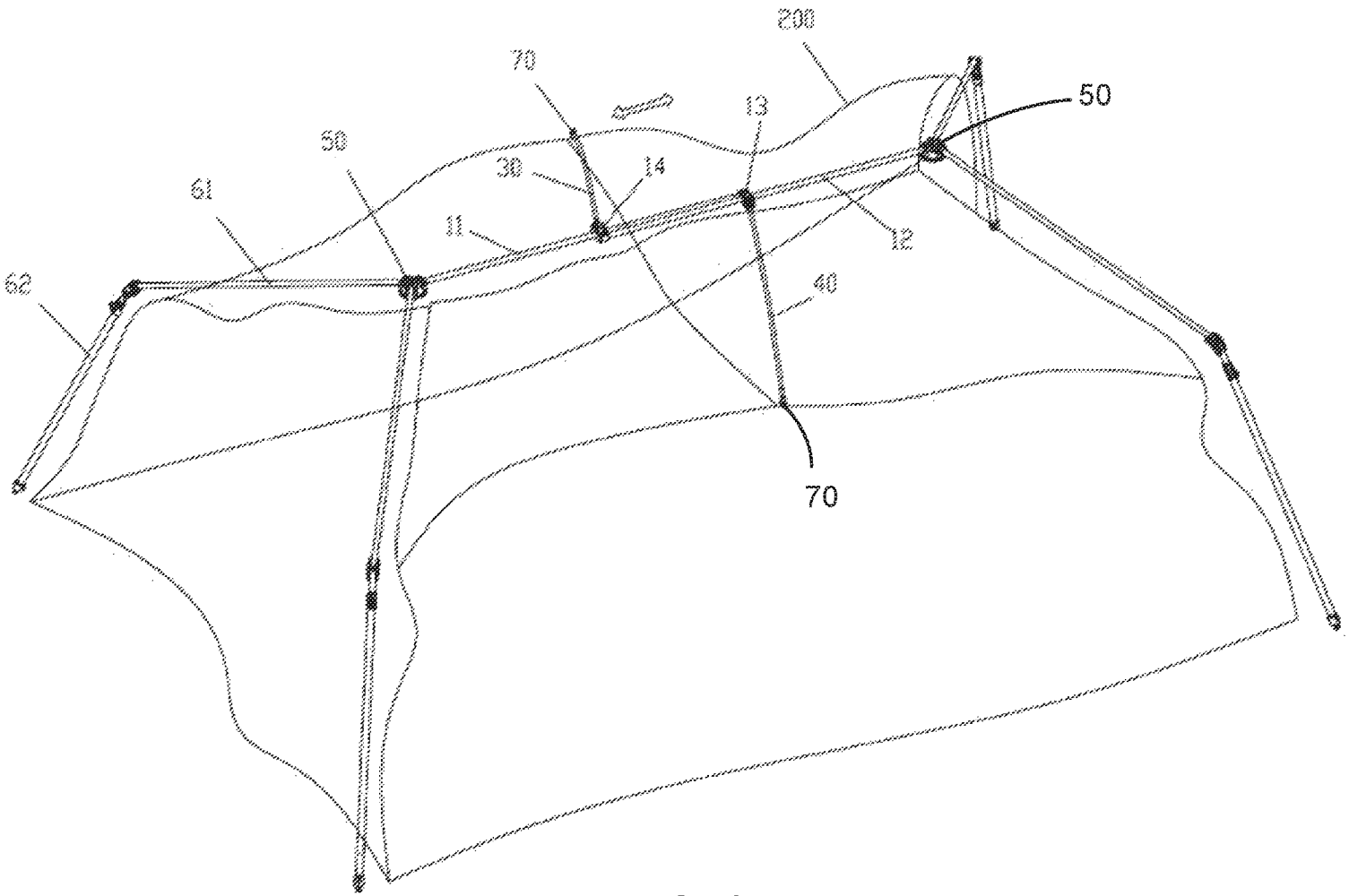
FIG. 4 is a schematic diagram illustrating the exemplary tent of FIG. 1 in a second partially folded state in accordance with some exemplary embodiments of the present invention.
Figure 5:
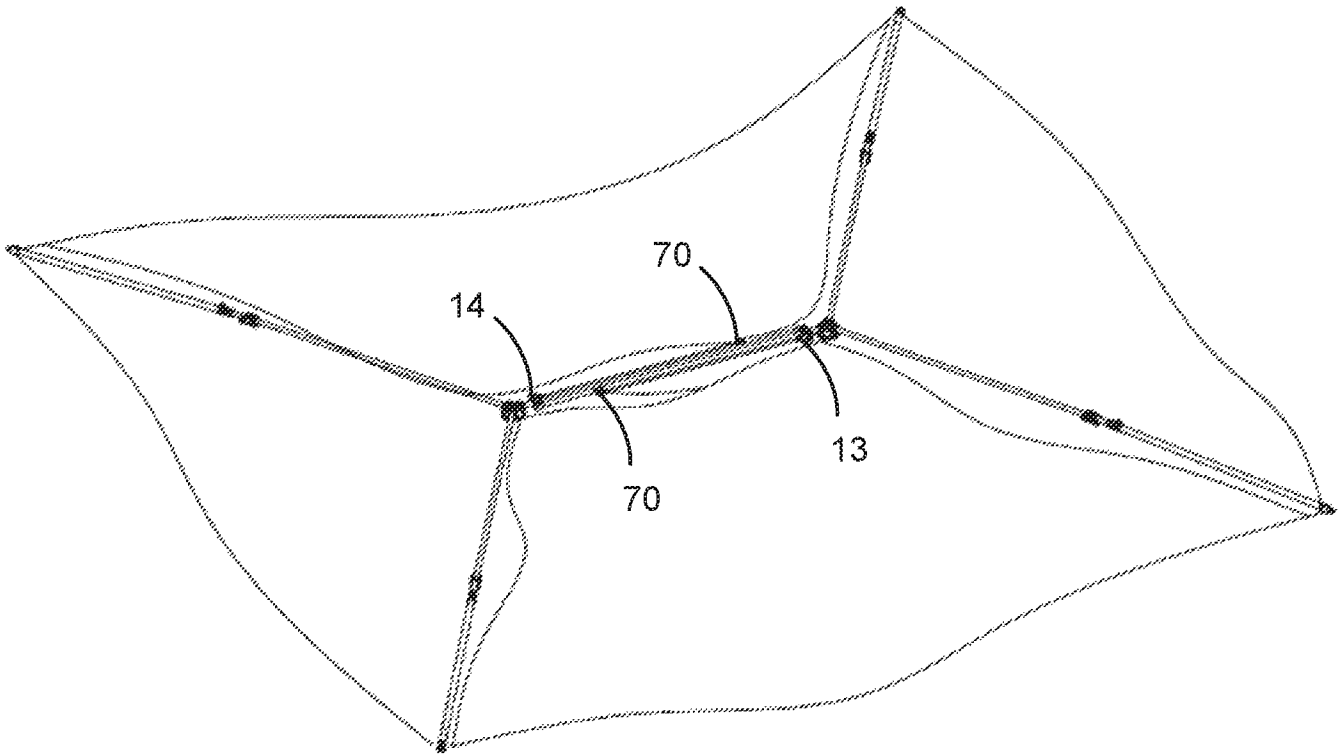
FIG. 5 is a schematic diagram illustrating the exemplary tent of FIG. 1 in a third partially folded state in accordance with some exemplary embodiments of the present invention.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of tents and tent frames. Tents and tent frames of the present invention can be of various sizes and shapes. Generally, a tent frame of the present invention includes first and second top poles, and first and second connectors fixedly coupled to one of the first and second top poles and slidably coupled to the other of the first and second top poles. In various embodiments, a tent frame of the present invention also includes one or more rotatable poles each pivotally coupled to the first or second connector. As such, on one hand, the tent frames and the tents of the present invention when unfolded provide a relatively larger usable space, for example, to accommodate more people (e.g., four, six, eight, ten or more people). On the other hand, the tent frames and the tents of the present invention when folded are compact and require a relatively smaller storage space. Accordingly, they are convenient for shipping and transportation. In addition, the tent cloth can be folded and unfolded along with the tent frame of the present invention. As such, the tents of the present invention are very convenient to use.

Referring now to FIGS. 1-5, there is depicted an exemplary tent in accordance with some exemplary embodiments of the present invention. As show, tent 1 includes a tent frame such as tent frame 100 and a tent cloth such as tent cloth 200 coupled to and supported by the tent frame.

Tent frame 100 includes top poles such as first top pole 11 and second top pole 12. First top pole 11 has a first end portion (e.g., the portion at or adjacent to reference numeral 13 in FIG. 4) and a second end portion (e.g., the portion at or adjacent to reference numeral 50 on the left side of FIG. 4). Similarly, second top pole 12 has a first end portion (e.g., the portion at or adjacent to reference numeral 14 in FIG. 4) and a second end portion (e.g., the portion at or adjacent to reference numeral 50 on the right side of FIG. 4).

Tent frame 100 also includes connectors such as first connector 13 and second connector 14. First connector 13 is fixedly coupled to the first end portion of the first top pole, and slidably coupled to and movable along the second pole. Second connector 14 is fixedly coupled to the first end portion of the second top pole, and slidably coupled to and movable along the first top pole.

Figure 6:
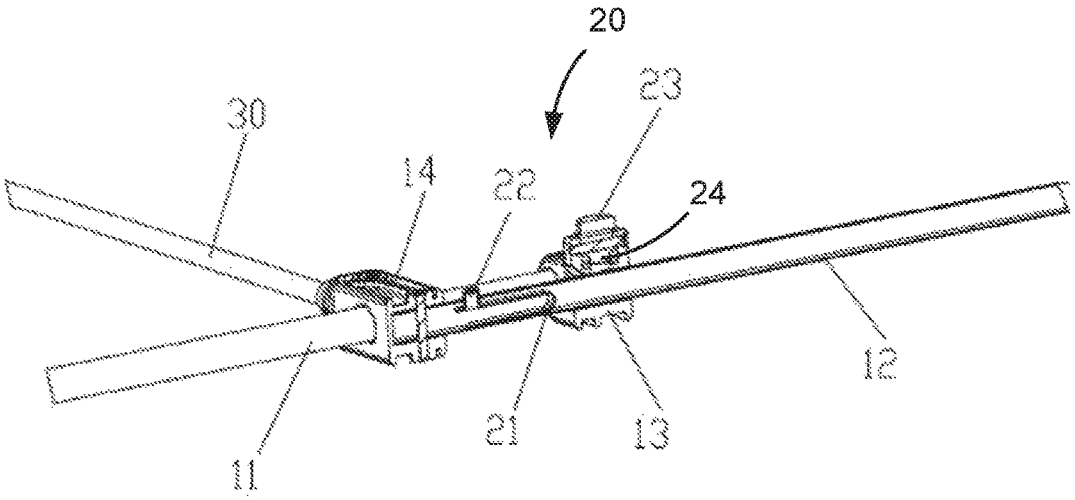
FIG. 6 is a schematic diagram illustrating an exemplary locking mechanism in an unlocked state in accordance with some exemplary embodiments of the present invention.
Figure 7:
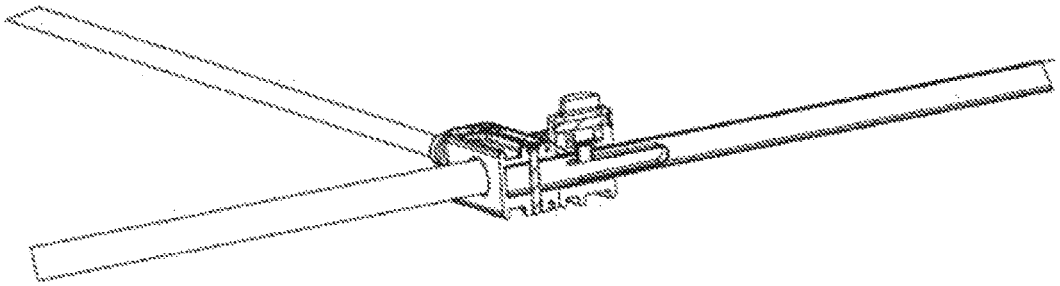
FIG. 7 is a schematic diagram illustrating the exemplary locking mechanism of FIG. 6 in a locked state in accordance with some exemplary embodiments of the present invention.

Tent frame 100 further includes a locking mechanism such as locking mechanism 20 to selectively restrict the first and second top poles from moving with respect to each other. Referring to FIGS. 6 and 7, in some exemplary embodiments, locking mechanism 20 includes a U-shaped elastic member such as U-shaped elastic member 21 and a protrusion such as protrusion 22 disposed at or integrally formed with the U-shaped elastic member. In an exemplary embodiment, the protrusion is disposed or integrally formed at an end portion of the U-shaped elastic member. In an exemplary embodiment, the protrusion is a boss or the like.

To accommodate the U-shaped elastic member, the second top pole or at least the first end portion of the second top pole is hollow, with a hole formed on a side wall at or adjacent to the first end portion of the second top pole. The U-shaped elastic member is disposed inside of the first end portion of the second top pole, and pushes the protrusion outwardly such that the protrusion protrudes outside of the second top pole through the hole formed at the first end portion of the second top pole.

Locking mechanism 20 also includes a knob formed with a push button such as push button 23 and a receptacle such as receptacle 24. In an exemplary embodiment, the knob is disposed at or formed integrally with first connector 13. In an exemplary embodiment, the knob is fixedly disposed at the first end portion of the first top pole. The receptacle is configured to receive the protrusion and thus restricts the first and second top poles from moving with respect to each other, thereby assisting in stabilizing the tent when unfolded. The push button is configured to push the protrusion and thus release the protrusion from the receptacle of the knob or from both the receptacle of the knob and the hole formed at the first end portion of the second top pole. As a result, the first and second top poles are allowed to move with respect to each other, thereby allowing the tent and the tent frame to fold or unfold.

In some exemplary embodiments, tent frame 100 includes one or more rotational poles to assist in supporting, extending and/or stretching the tent cloth. For instance, in an exemplary embodiment, tent frame 100 includes first rotatable pole 40 with its first end portion pivotally connected to first connector 13 such that the first rotatable pole can be rotated between a first position and a second position. In an exemplary embodiment, first rotational pole 40 is rotatable towards the second connector between a first position that is substantially perpendicular to the second top pole (e.g., the position shown in FIG. 1) and a second position that is substantially parallel to the second top pole (e.g., the position shown in FIG. 5). In some exemplary embodiments, the second end portion of the first rotatable pole includes a fastener such as first fastener 70 (e.g., fastener 70 at the front side of the tent in FIG. 4) to couple with the tent cloth. The first fastener can be a buckle, a strip of fabric, or the like. Accordingly, the tent cloth can be unfolded or unfolded along with the tent frame.

In some exemplary embodiments, tent frame 100 includes second rotatable pole 30. Similar to first rotatable pole 40, second rotatable pole 30 has its first end portion pivotally connected to the second connector such that the second rotatable can be rotated between a third position and a fourth position. In an exemplary embodiment, the second rotatable pole is rotatable towards the first connector between a third position that is substantially perpendicular to the first top pole and a fourth position that is substantially parallel to the first top pole. In an exemplary embodiment, the second rotatable pole includes a second fastener such as second fastener 70 (e.g., fastener 70 at the back side of the tent in FIG. 4) at its second end portion to couple with the tent cloth.

In some exemplary embodiments, tent frame 100 also includes a plurality of supporting poles such as supporting poles 60 pivotally connected to the second end portions of the first and second top poles. The plurality of supporting poles supports the first and second top poles when the tent frame is unfolded. For instance, in some exemplary embodiments, tent frame 100 includes a third connector such as third connector 50 (e.g., the connector on the left side of FIG. 4) to pivotally connect a first plurality of supporting poles with the second end portion of first top pole 11. The first plurality of supporting poles can include two, three, or more supporting poles. Tent frame 100 also includes a fourth connector such as fourth connector 50 (e.g., the connector on the right side of FIG. 4) to pivotally connect a second plurality of supporting poles with the second end portion of the second top pole. The second plurality of supporting poles can include the same number of supporting poles as the first plurality of supporting poles or different number of supporting poles.

In some exemplary embodiments such as those illustrated in FIGS. 1-5, supporting pole 60 in the first or second plurality of supporting poles includes an upper supporting pole such as upper supporting pole 61 and a lower supporting pole such as lower supporting pole 62. The upper supporting pole has first and second end portions, with the first end portion pivotally connected to the third or fourth connector, and the second end portion pivotally connected to a first end portion of the lower supporting pole. The second end portion of the lower supporting pole is configured to be disposed at a ground. In an exemplary embodiment, lower supporting pole 62 is telescopic, or has a length that is adjustable.

Referring to FIGS. 8-12, in an exemplary alternative embodiment, supporting pole 60 includes lower supporting pole 62 but not upper supporting pole 61. In such an exemplary embodiment, the first end portion of the lower supporting pole 62 is pivotally connected to the first or second top poles through the third or fourth connector.

Referring to FIGS. 1-5 and 8-12, the tents and the tent frames of the present invention are easy to fold and unfold. For instance, FIG. 1 illustrates a tent of the present invention in an unfolded state. To fold the tent, retract the lower supporting poles and rotate upwardly the retracted lower supporting poles toward the corresponding upper poles. Retract the first and second top poles. While the first and second top poles are retracting, the rotatable poles rotate towards the first and second top poles and are eventually placed side by side with the first and second top poles. Rotation of the rotatable poles in turn folds the tent cloth. It should be noted that retracting of the first and second top poles can be performed prior to or subsequent to retracting of the lower supporting poles. Afterwards, rotate the upper supporting pole along with the lower supporting pole towards the top poles to complete the folding process.

Figure 8:
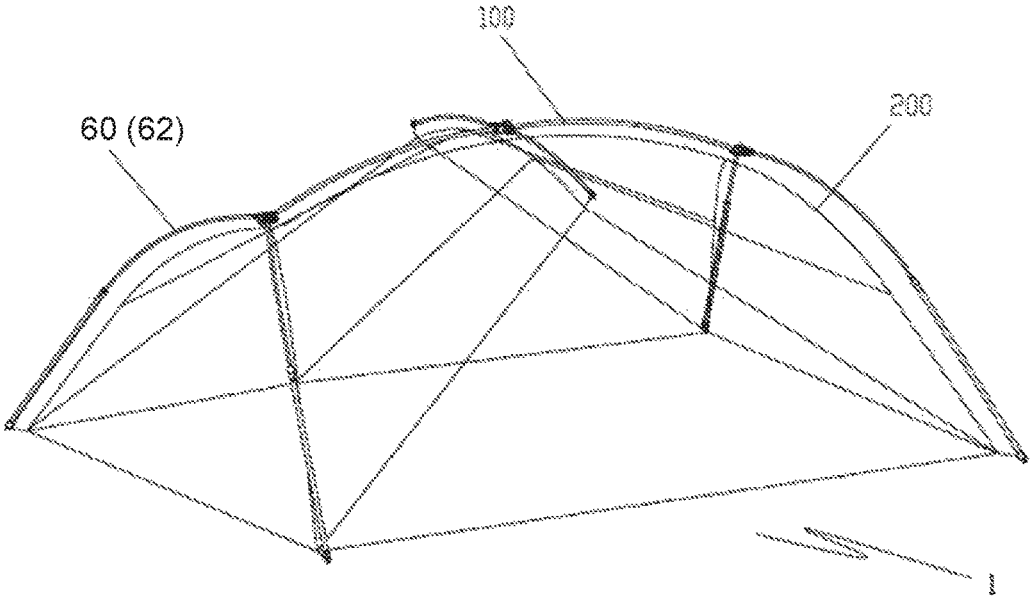
FIG. 8 is a schematic diagram illustrating an exemplary alternative tent in an unfolded state in accordance with some exemplary embodiments of the present invention.
Figure 9:
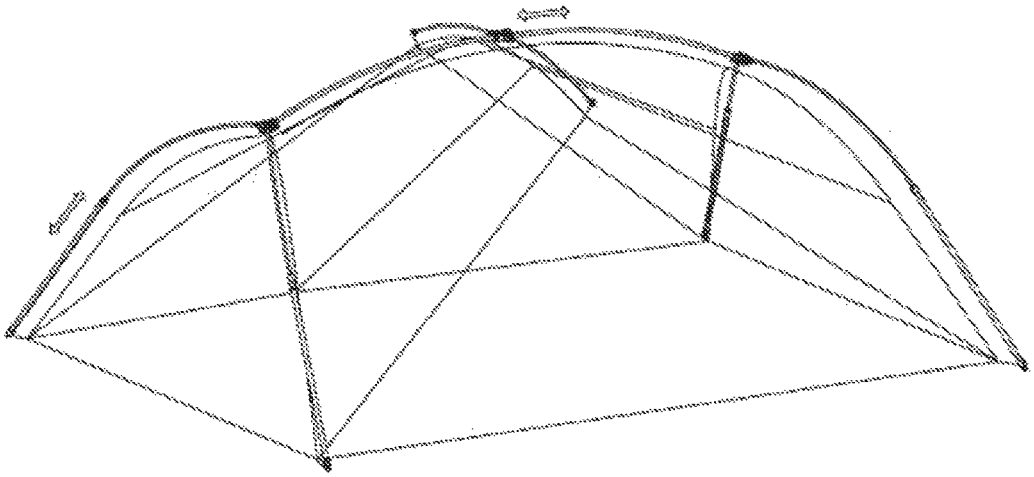
FIG. 9 is a schematic diagram illustrating exemplary folding and unfolding processes of the exemplary alternative tent of FIG. 8 in accordance with some exemplary embodiments of the present invention.
Figure 10:
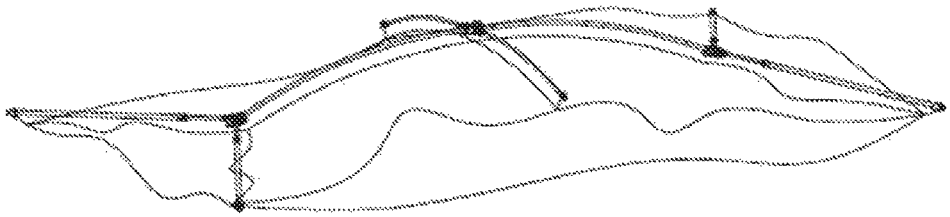
FIG. 10 is a schematic diagram illustrating the exemplary alternative tent of FIG. 8 in a first partially folded state in accordance with some exemplary embodiments of the present invention.
Figure 11:
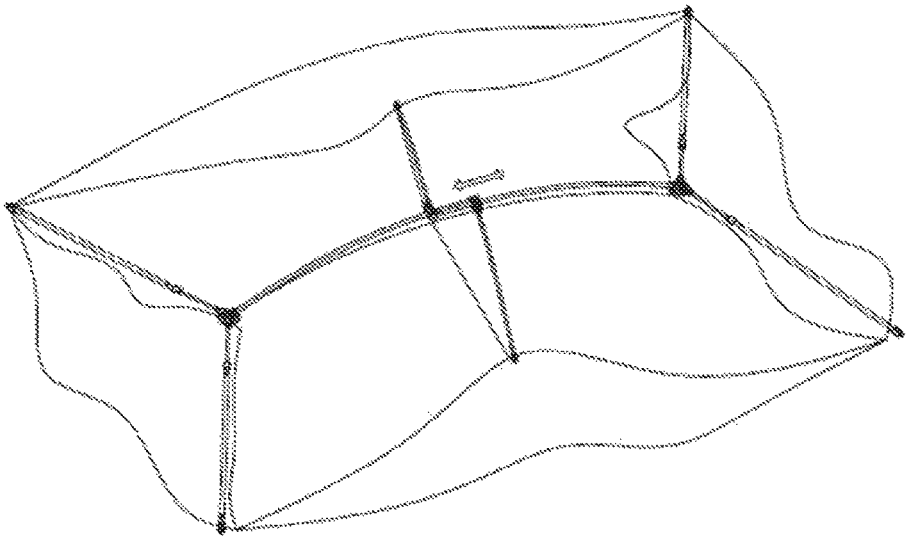
FIG. 11 is a schematic diagram illustrating the exemplary alternative tent of FIG. 8 in a second partially folded state in accordance with some exemplary embodiments of the present invention.
Figure 12:
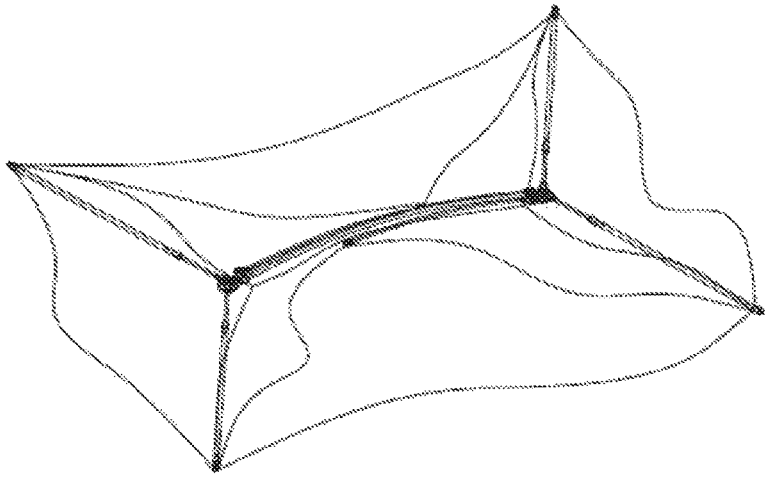
FIG. 12 is a schematic diagram illustrating the exemplary alternative tent of FIG. 8 in a third partially folded state in accordance with some exemplary embodiments of the present invention.
Figure 13:
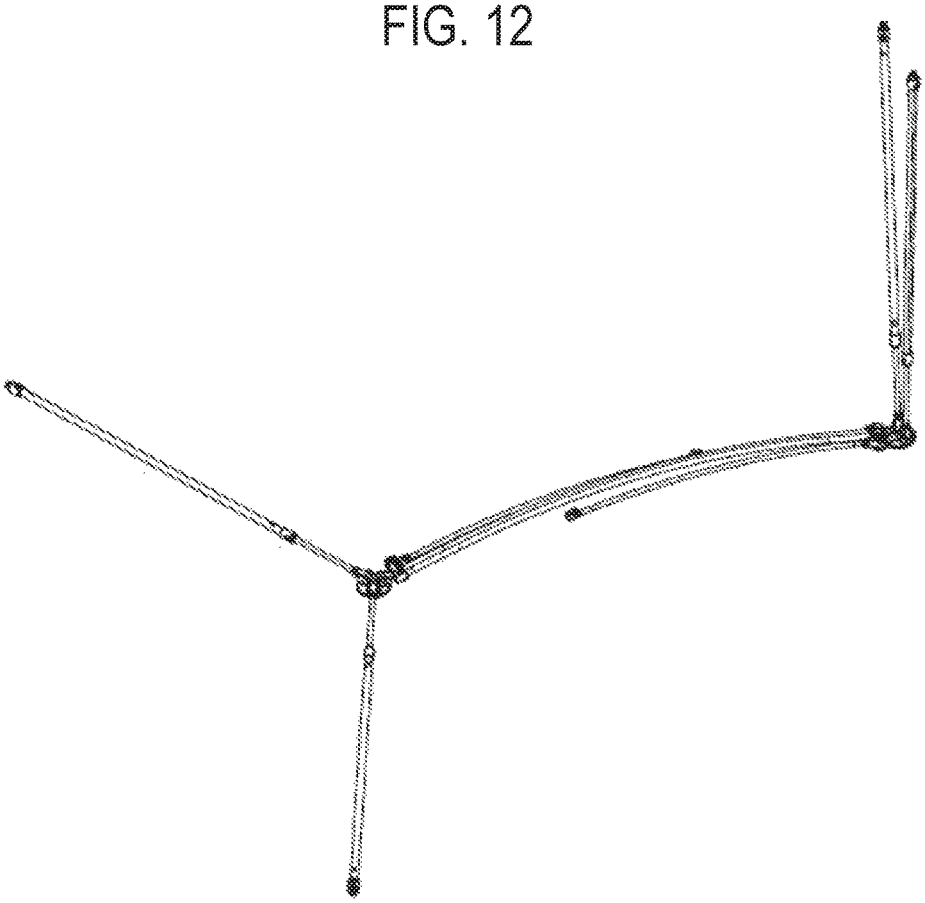
FIG. 13 is a schematic diagram illustrating an exemplary tent frame in a partially folded state in accordance with some exemplary embodiments of the present invention.
Figure 14:
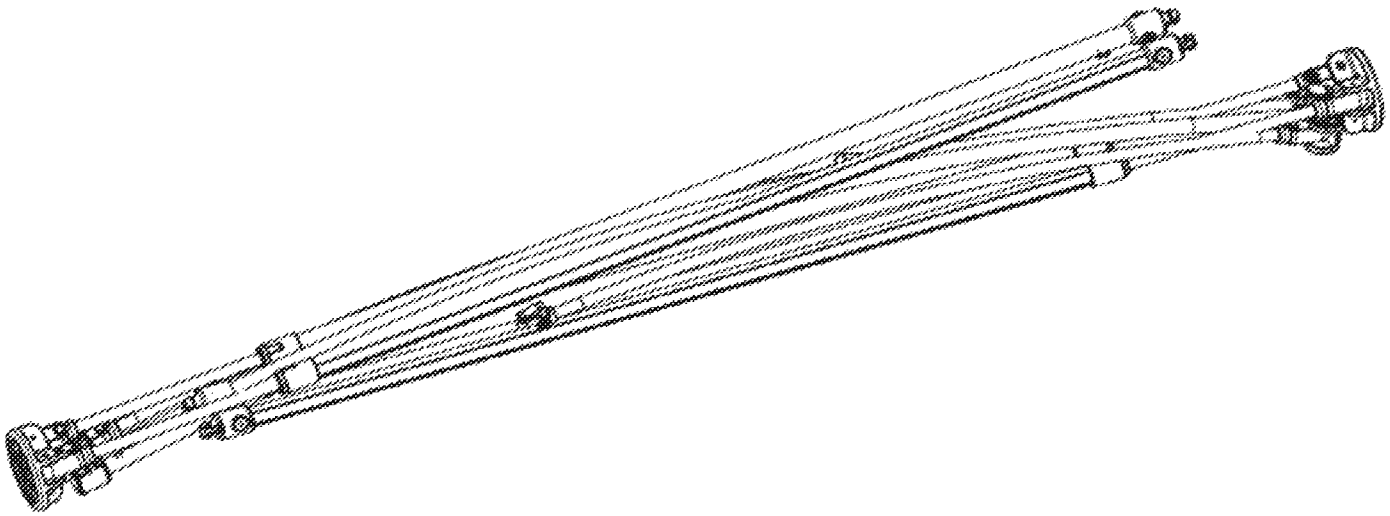
FIG. 14 is a schematic diagram the exemplary tent frame of FIG. 13 in a folded state in accordance with some exemplary embodiments of the present invention.

Similarly, FIG. 8 illustrates an alternative tent of the present invention in an unfolded state. To fold the alternative tent, retract the lower supporting poles and retract the first and second top poles. Then, rotate the retracted lower supporting poles towards the top poles as illustrated in FIG. 13 to complete the folding process. The folded tent frame is illustrated in FIG. 14. Reversing the processes will unfold the tent frames and the tents.

As disclosed herein, the tent frames and the tents of the present invention have several advantages. For instance, the tent frames and the tents of the present invention when unfolded provide a relatively larger usable space and thus can accommodate more people. The tent frames and the tents of the present invention when folded are compact and require a relative smaller storage space, and are thus convenient for shipping and transportation. Also, the tent frames and the tents of the present invention are easy to fold and unfold. In addition, the tent cloth can be folded together with the tent frame. As such, there is no need to fold the tent frame and the tent cloth separately, making the tents of the present invention very convenient to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "left" or "right", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. A tent frame comprising:

first and second top poles, each having a first end portion and a second end portion;

a first connector fixedly coupled to the first end portion of the first top pole, and slidably coupled to and movable along the second pole;

a second connector fixedly coupled to the first end portion of the second top pole, and slidably coupled to and movable along the first top pole; and a locking mechanism to selectively restrict the first and second top poles from moving with respect to each other, wherein at least the first end portion of the second top pole is hollow and comprises a hole formed at a wall thereof, wherein the locking mechanism comprises:

a U-shaped elastic member disposed inside of the first end portion of the second top pole;

a protrusion disposed at or integrally formed with the U-shaped elastic member, the U-shaped elastic member pushing the protrusion outwardly such that the protrusion is protruded outside of the second top pole through the hole formed at the first end portion of the second top pole; and a knob disposed at or integrally formed with the first connector, the knob comprising:

a receptacle to receive the protrusion, thereby restricting the first and second top poles from moving with respect to each other, and a push button to push the protrusion out of the receptacle of the knob or out of both the receptacle of the knob and the hole formed at the first end portion of the second top pole, thereby allowing the first and second top poles to move with respect to each other.

2. The tent frame of claim 1, wherein the protrusion is disposed or integrally formed at or adjacent to an end of the U-shaped elastic member.

3. The tent frame of claim 1, further comprising:

a first rotatable pole having a first end portion thereof pivotally connected to the first connector.

4. The tent frame of claim 3, further comprising:

a second rotatable pole having a first end portion thereof pivotally connected to the second connector.

5. The tent frame of claim 1, further comprising:

a third connector pivotally connected to the second end portion of the first top pole;

a fourth connector pivotally connected to the second end portion of the second top pole;

a first plurality of supporting poles, each pivotally connected to the third connector; and a second plurality of supporting poles, each pivotally connected to the fourth connector.

6. A tent frame comprising:

first and second top poles, each having a first end portion and a second end portion;

a first connector fixedly coupled to the first end portion of the first top pole, and slidably coupled to and movable along the second pole;

a second connector fixedly coupled to the first end portion of the second top pole, and slidably coupled to and movable along the first top pole;

a locking mechanism to selectively restrict the first and second top poles from moving with respect to each other; and a first rotatable pole having a first end portion thereof pivotally connected to the first connector, wherein the first rotatable pole is rotatable towards the second connector between a first position and a second position.

7. The tent frame of claim 6, wherein the first rotatable pole includes a first fastener at a second end portion thereof to couple with a tent cloth.

8. The tent frame of claim 6, wherein the first position is substantially perpendicular to the second top pole and the second position is substantially parallel to the second top pole.

9. The tent frame of claim 6, further comprising:

a second rotatable pole having a first end portion thereof pivotally connected to the second connector, wherein the second rotatable pole is rotatable towards the first connector between a third position and a fourth position.

10. The tent frame of claim 9, wherein the second rotatable pole includes a second fastener at a second end portion thereof to couple with a tent cloth.

11. The tent frame of claim 9, wherein the third position is substantially perpendicular to the first top pole and the fourth position is substantially parallel to the first top pole.

12. A tent comprising:
a tent cloth; and
the tent frame of claim 6 to support the tent cloth when the tent is unfolded.

13. A tent frame comprising:
first and second top poles, each having a first end portion and a second end portion;
a first connector fixedly coupled to the first end portion of the first top pole, and slidably coupled to and movable along the second pole;
a second connector fixedly coupled to the first end portion of the second top pole, and slidably coupled to and movable along the first top pole;
a locking mechanism to selectively restrict the first and second top poles from moving with respect to each other; and
a second rotatable pole having a first end portion thereof pivotally connected to the second connector, wherein the second rotatable pole is rotatable towards the first connector between a third position and a fourth position.

14. A tent comprising:
a tent cloth; and
the tent frame of claim 13 to support the tent cloth when the tent is unfolded.

15. A tent frame comprising:
first and second top poles, each having a first end portion and a second end portion;
a first connector fixedly coupled to the first end portion of the first top pole, and slidably coupled to and movable along the second pole;
a second connector fixedly coupled to the first end portion of the second top pole, and slidably coupled to and movable along the first top pole;
a locking mechanism to selectively restrict the first and second top poles from moving with respect to each other; and
a third connector pivotally connected to the second end portion of the first top pole;
a fourth connector pivotally connected to the second end portion of the second top pole;
a first plurality of supporting poles, each pivotally connected to the third connector; and
a second plurality of supporting poles, each pivotally connected to the fourth connector.

16. The tent frame of claim 15, wherein the first or second plurality of supporting poles comprises two, three or more supporting poles.

17. The tent frame of claim 15, wherein each supporting pole in the first or second plurality of supporting poles is telescopic, or has a length that is adjustable.

18. The tent frame of claim 15, wherein each supporting pole in the first or second plurality of supporting poles comprises:
an upper supporting pole having first and second end portions, the first end portion thereof pivotally connected to the third or fourth connector; and
a lower supporting pole having a first end portion pivotally coupled to the second end portion of the upper supporting pole, and a second end portion to be disposed at a ground.

19. The tent frame of claim 18, wherein the lower supporting pole is telescopic, or has a length that is adjustable.

20. A tent comprising:
a tent cloth; and
the tent frame of claim 15 to support the tent cloth when the tent is unfolded.

21. A tent comprising:
a tent cloth; and
a tent frame to support the tent cloth when the tent is unfolded, wherein the tent frame comprises:
first and second top poles, each having a first end portion and a second end portion;
a first connector fixedly coupled to the first end portion of the first top pole, and slidably coupled to and movable along the second pole;
a second connector fixedly coupled to the first end portion of the second top pole, and slidably coupled to and movable along the first top pole; and
a locking mechanism to selectively restrict the first and second top poles from moving with respect to each other;
wherein at least the first end portion of the second top pole is hollow and comprises a hole formed at a wall thereof,
wherein the locking mechanism comprises:
a U-shaped elastic member disposed in the second top pole at the first end portion thereof;
a protrusion disposed at or integrally formed with the U-shaped elastic member, the U-shaped elastic member pushing the protrusion outwardly such that the protrusion is protruded outside of the second top pole through the hole formed at the first end portion of the second top pole; and
a knob disposed at the first connector, the knob comprising:
a receptacle to receive the protrusion, thereby restricting the first and second top poles from moving with respect to each other, and
a push button to release the protrusion from the receptacle of the knob or from both the receptacle of the knob and the hole formed at the first end portion of the second top pole, thereby allowing the first and second top poles to move with respect to each other.

22. The tent of claim 21, wherein the tent frame further comprises:
a first rotatable pole having a first end portion thereof pivotally connected to the first connector, wherein the first rotatable pole is rotatable towards the second connector between a first position and a second position; and
a second rotatable pole having a first end portion thereof pivotally connected to the second connector, wherein the second rotatable pole is rotatable towards the first connector between a third position and a fourth position.

23. The tent of claim 21, wherein the tent frame further comprises:
a third connector pivotally connected to the second end portion of the first top pole;
a fourth connector pivotally connected to the second end portion of the second top pole;
a first plurality of supporting poles, each pivotally connected to the third connector; and
a second plurality of supporting poles, each pivotally connected to the fourth connector.

* * * * *